US005114111A

United States Patent [19]

Andrews

[11] Patent Number: 5,114,111

[45] Date of Patent: May 19, 1992

[54] MUSIC STAND

[76] Inventor: Kim N. Andrews, 1552 Harvard St. #6, Santa Monica, Calif. 90404

[21] Appl. No.: 676,760

[22] Filed: Mar. 25, 1991

Related U.S. Application Data

[63] Continuation-in-part of Ser. No. 462,781, Jan. 10, 1990, Pat. No. 5,037,057.

[51] Int. Cl.[5] ..... A47B 97/00

[52] U.S. Cl. ..... 248/460; 248/448

[58] Field of Search ..... 248/460, 447, 461, 441.1, 248/462, 448, 472; 108/102

[56] References Cited

U.S. PATENT DOCUMENTS

| | | | |
|---|---|---|---|
| 564,785 | 7/1896 | Geer | 248/448 X |
| 575,729 | 1/1897 | Palmer | 248/448 |
| 1,037,233 | 9/1912 | Furrow | 248/448 |
| 1,064,077 | 6/1913 | Lewyt | 248/447 |
| 1,818,717 | 8/1931 | Kliegl | 248/448 |
| 1,862,562 | 6/1932 | Aldeen et al. | 248/447 |
| 2,474,532 | 6/1949 | Kitchen | 248/461 |
| 3,938,772 | 2/1976 | Andrusiak | 248/461 |
| 4,610,417 | 9/1986 | Kuss | 248/460 |

*Primary Examiner*—Karen J. Chotkowski
*Attorney, Agent, or Firm*—Jack C. Munro

[57] ABSTRACT

A collapsible music stand composed of a plurality of foldable panels which are mounted on a tripod base. Sheet music is to be located against the foldable panels. Foldable panels include a center panel with one side panel mounted to the right edge of the center panel and another side panel mounted to the left edge of the center panel. The side panels have bottom edges which are slightly misaligned from the bottom edge of the center panel so that the side panels can be pivoted to rest against the front side of the center panel with the bottom edges of the side panels not interfering with the lower edge of the center panel. The side panels are capable of assuming a substantially aligned position with the center panel with the side panels being slightly inclined so that relative to the front side of the center panel there is formed a slightly concave configuration. Pivotal shelf members are mounted to the bottom edges of the side panel and to the lower edge of the center panel.

3 Claims, 1 Drawing Sheet

MUSIC STAND

REFERENCE TO PRIOR APPLICATION

This is a Continuation-in-Part of patent application Ser. No. 07/462,781, filed Jan. 10, 1990, by the same inventor, entitled COLLAPSIBLE MUSIC STAND U.S. Pat. No. 5,037,057.

BACKGROUND OF THE INVENTION

1) Field of the Invention

The present invention relates to music stands and particularly to a music stand which incorporates extendable side panels to enlarge the usable area of the music stand when needed.

2) Description of Related Art

It is common for musicians to use music stands for holding sheet music during the playing of a musical instrument. It is common that music stands are designed to hold a single book of sheet music. When it is necessary to utilize additional books of sheet music, musicians use two or maybe even three in number of music stands located in a side-by-side arrangement. This results in a maze of music stands in the performing area. In a situation of an orchestra, there is usually limited space. Therefore, the utilization of the large number of music stands provides a confining situation. A musician may make a slight movement and cause a music stand to be knocked over.

It is common for musicians to move from one performing location to another. This means that the musician must carry his/her own equipment. In order to facilitate the carrying of one's own equipment, it is common to utilize a collapsible music stand. Thus, there has been a need in the past for a collapsible music stand which provides an enlarged support area for sheet music. There are of course times when only a single book of sheet music is being utilized and not requiring the need for the enlarged area.

In the past, there have been constructed music stands which were collapsible and could be utilized to support a single book of music and could be modified to accommodate multiple books of music. Such a music stand is shown and described within the aforementioned parent patent application. The music stand of the present invention is similar to the stand of the parent application in that there is utilized a center panel to which are mounted on each side thereof a side panel. These side panels are movable to either an extended position in substantial alignment with the center panel or are movable in abutting juxtaposition to the center panel. When in the extended position, the music stand can accommodate multiple books of music. When the side panels are in juxtaposition to the center panel, the music stand can accommodate a single book of music.

One advantage of the music stand of the present invention over that of the stand disclosed in the parent application is that there is eliminated any need of any locking arrangement between the side panels and the center panel. The total number of panels utilized within the present invention are reduced while yet maintaining the same overall extended width of the music stand that is disclosed within the parent application.

SUMMARY OF THE INVENTION

The music stand of the present invention is to be collapsible between a usable position and a transporting position. The music stand is mounted on a conventional tripod base. The music stand includes a center panel which is pivotally mounted to the upper end of the tripod base. Mounted on the lower edge of the center panel is a shelf member with this shelf member being pivotable for stowage from a position directly adjacent the front side of the center panel to a substantially right angled position which would be the position the shelf panel occupies during usage. Pivotally mounted on both the right and left sides of the center panel are side panels. Each side panel includes a similarly mounted pivotable shelf member. Each side panel and its connected shelf member are capable of pivoting between a position in abutting juxtaposition to the center panel to a position substantially in alignment therewith. The shelf members of the side panel are misaligned from the shelf member of the center panel so that there is no interference between the two during this pivoting action. Also, when the side panels are located in substantial alignment with the center panel, there is a slight inclination therebetween forming a slightly concave configuration relative to the front side of the center panel.

One of the primary objectives of the present invention is to construct a music stand that when placed in the using position produces a panoramic view of sheets of music which are placed on the music stand slightly encircling the viewer keeping the sheet music easy to read, minimizing straining or leaning of the viewer to see the sheet music that is not precisely within center view.

Another objective of the music stand of the present invention is that by allowing the side panels and their attached shelves to swing over and upon the center panel permits the stand to be used as a traditional stand for a single music book.

Another objective of the present invention is that by locating of the shelves for the side panels in their extended (usable) position, and then turning of the side panels inwardly, results in the side panels, in combination with the center panel, forming a U-shaped configuration thereby producing a windproof viewing area which facilitates usage of the stand in an outdoor windy environment.

Another objective of the present invention is to produce a flat unobstructed writing surface on both the center panel and the side panels which provides a writing surface free of rivets and other type of fasteners which would normally interfere with the writing of notes on sheet music which is common during composing.

Another objective of the present invention is to permit the head of the music stand to be moved to a lower position than with prior art music stands facilitating its transportability in confined areas.

Another objective of the present invention is to incorporate a convenient locking mechanism associated with the panels to hold the panels in an overlapped condition facilitating transportability.

Another objective of the present invention is to construct a music stand which is simple in construction and is constructed from readily available stock eliminating use of special construction parts.

DETAILED DESCRIPTION OF THE SHOWN EMBODIMENT

Figure 1:
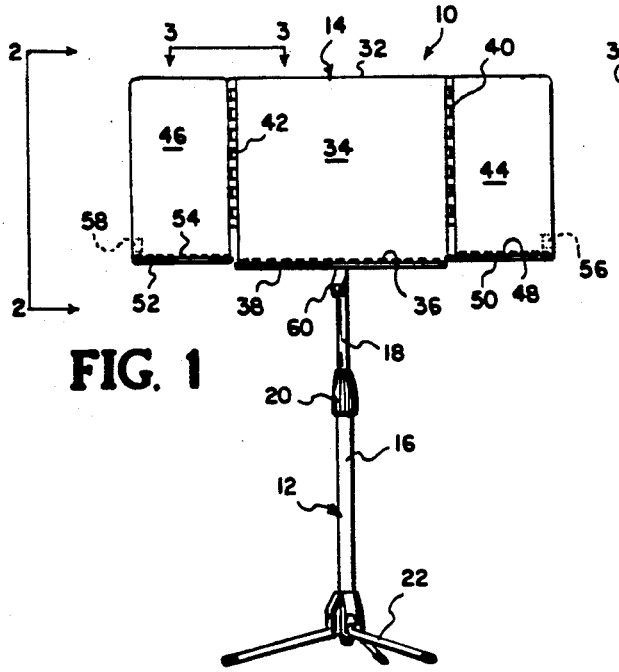
FIG. 1 is a front elevational view of the music stand of the present invention showing the music stand in its expanded (usable) position with the side panels being in substantial alignment with the center panel.

Referring particularly to the drawing, there is shown the music stand 10 of this invention. Stand 10 is composed of a conventional tripod assembly 12 and a head 14. Tripod 12 is deemed to be conventional and is formed of a pair of telescoping members 16 and 18 with member 18 being lineally movable within member 16. Once the desired position of the telescoping members 16 and 18 has been attained, handle tightening sleeve 20 is to be moved fixing the position of member 18 relative to member 16. At the bottom end of member 16 are a plurality of foldable legs 22. The basic construction of the tripod assembly 12 is deemed to be conventional.

The upper end of member 18 is fitted within a sleeve 24. Sleeve 24 is located in a close fitting relationship between a pair of plates 26 with only one such plate being shown. Passing through the plates 26 and the sleeve 24 is a bolt-type of fastener 28. The bolt-type fastener 28 can be operated manually to be either tightened or loosened. When it is tightened, the position of the head 14 is fixed relative to the tripod 12. The head 14 can be located in any inclined position with only the inclined position shown in FIG. 2 being representative. The head 14 could be tilted to be in a more upright position or could be in a more inclined position. Also, the head 14 can be moved approximately one hundred sixty degrees counterclockwise from the position shown in FIG. 2 which would cause the major portion of the head 14 to be located alongside of member 18 thereby minimizing the overall height of the music stand 10. With the head 14 in this position, transportability is facilitated so that the stand 10 will occupy a minimum amount of space.

Plates 26 are welded or otherwise secured adjacent the transverse midpoint to the backside 30 of a center panel 32. The center panel 32 also has a front side 34. The center panel 32 has an upper edge which is shown in FIG. 1 as being furthest from the tripod 12. At the lower edge of the center panel 32 there is pivotally mounted by a hinge 36 a shelf member 38. It is to be understood that this shelf member 38 is to be located in a substantially right angle position as is clearly shown in the drawings, or can be moved to abut against the front side 34 of the center panel 32. The actual length of the shelf member 38 will be between two to three inches. The width of the shelf member 38 will be equal to the width of the center panel 32 with the typical width being approximately eighteen inches. The height of the center panel 32 will be approximately thirteen inches.

The center panel 32 has a right side edge on which is mounted a hinge 40. On the left side edge of the center panel 32 is mounted a hinge 42. Connected to the hinge 40 is a right side panel 44. Connected to the hinge 42 is a left side panel 46. It is to be noted that the panels 44 and 46 are basically identical in shape and each include a planar front surface and a planar back surface. Panels 44 and 46 are constructed of sheet material similar in construction to the sheet material of center panel 32. A typical sheet material would be metal, such as steel or aluminum. The panels 44 and 46 are each approximately one-half in width of the center panel 32. Therefore, when the panels 44 and 46 are deployed as shown in FIG. 1, the overall width of the head 14 is doubled as opposed to what would be the width of the head 14 when the panels 44 and 46 were placed in abutting juxtaposition to the front side 34 of the center panel 32. The height of the panels 44 and 46 is slightly less than the height of the center panel 32.

Pivotally mounted to the lower edge of the panel 44 by means of a hinge 48 is a shelf member 50. In a similar manner, a similarly sized shelf member 52 is pivotally connected by hinge 54 to the panel 46. The outward extension or length of the shelf members 50 and 52 is identical and equal to the length of the shelf member 38. However, this length could be varied between the shelf members if such is deemed to be desirable. It is to be noted that the shelf members 50 and 52 each extend across the entire width of their respective panels 44 and 46.

Mounted on the backside of the panel 44 is a small pad 56. A similar pad 58 is fixedly mounted on the backside of the panel 46. Pads 56 and 58 are each to contain a mass of tiny eyelets. These eyelets are to be connectable to a mass of tiny hooks which are formed on fastening strip 60. Strip 60 is fixedly secured to the backside 30 of the center panel 32. When shelf 38 is in the transport position and panels 44 and 46 are in abutting juxtaposition to the center panel 32, the pad 60 composed of the mass of tiny hooks is to fastenly engage simultaneously to both pads 56 and 58 thereby securing this folded position so that this will be maintained during transport of the music stand 10 preventing panels 44 and 46 from accidently pivoting away from the center panel 32 during this transporting.

Figure 2:
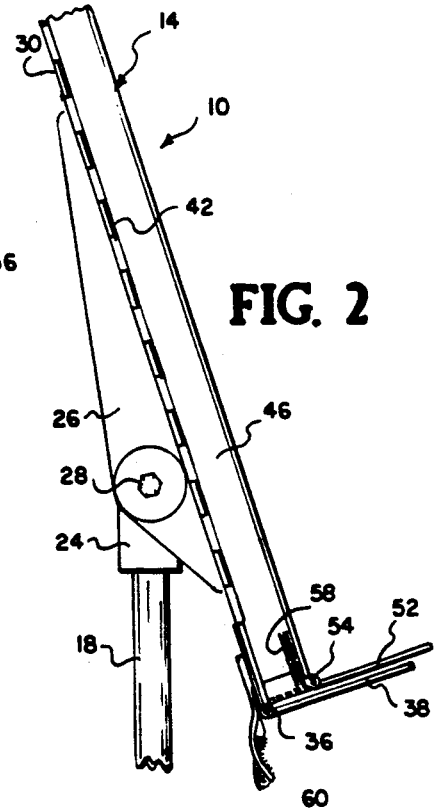
FIG. 2 is an end view of the music stand of the present invention taken along line 2—2 of FIG. 1.
Figure 3:
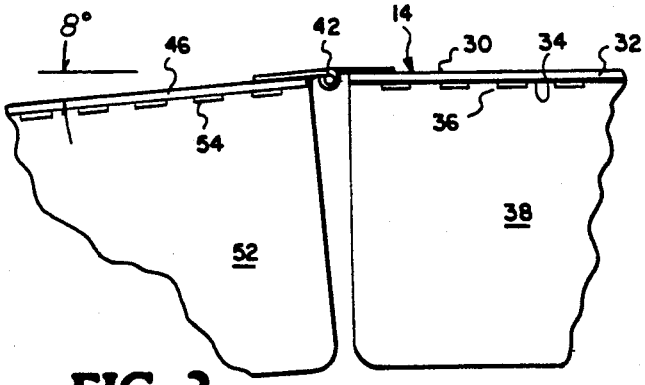
FIG. 3 is a top plan view of a portion of the music stand taken along line 3—3 of FIG. 1.
Figure 4:
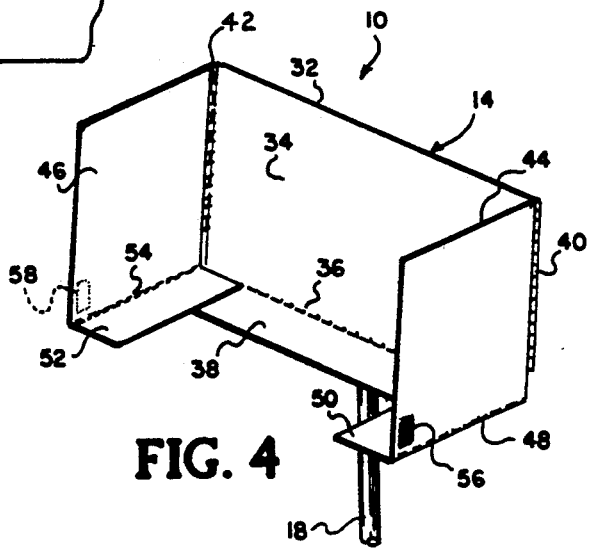
FIG. 4 is an isometric view of the head portion of the music stand of the present invention showing the panels in the position to be used in an outdoor windy environment.

In referring to FIG. 2, it can be seen that because of the height of the panels 44 and 46 is slightly less than the height of the center panel 32, the panels 44 and 46 can be pivoted relative to the center panel 32 between abutting juxtaposition to the center panel 32 to the expanded position shown in FIGS. 1 and 3 of the drawing. During this pivoting movement, the shelf members 50 and 52 do not interfere with the shelf segment 38 and actually override it as clearly shown in FIG. 2. This overriding of the shelf segment 38 is desirable so that the panels 44 and 46 can be located in the position shown in FIG. 4 which is a wind protective position for the music stand 10 when it is used in an outdoors environment.

Referring particularly to FIG. 3, it can be seen that when the panels 44 and 46 are in the extended position (in substantial alignment with center panel 32), that panels 44 and 46 are slightly inclined, approximately eight degrees, in a forward direction which produces a slightly concave configuration across the front surface of the head 14. This slightly foward tilting or inclination produces a slight encircling to the user or viewer keeping the music that is being read in an easy to see position eliminating any need for the viewer to strain or lean to see the music placed on the head 14 even if the music is not located in precisely center view. In other words, any music that is located against the panels 44 and 46 is easy to read as when music is placed against the front side 34 of the center panel 32.

What is claimed is:

1. A music stand comprising:

a tripod base adapted to be located on a supporting surface, said tripod base having an upper end spaced furthest from the supporting surface;

a substantially rectangular center panel having a backside and a front side, said planar center panel having an upper edge and a lower edge with said lower edge being located nearest said tripod base, said planar center panel having a right side edge and a left side edge, said upper end of said tripod base being connected to said backside;

a right side panel pivotally connected to said right side edge, a left side panel pivotally connected to said left side edge, both said right side panel and said left side panel being independently movable between a position in substantial planar alignment with said center panel to a position substantially perpendicular to said center panel, both said right side panel and said left side panel having a bottom edge, said bottom edges being misaligned from said lower edge so when said right side panel and said left side panel are in said position substantially perpendicular to said center panel said bottom edges are located nearer said lower edge than said upper edge and actually directly adjacent said lower edge;

a center shelf member being pivotally mounted to said lower edge of said center planar center panel, said center shelf member being constructed of thin sheet material and being capable of assuming a substantially right angled position relative to said front side;

a right side shelf member being pivotally mounted to said bottom edge of said right side panel, said right side panel having a front surface, said right side shelf member capable of assuming a position substantially perpendicular to said front surface, with said right side shelf member in said position substantially perpendicular to said front surface and said right side panel being substantially perpendicular to said center panel a portion of said right side shelf member overrides said center shelf member; and a left side shelf member being pivotally mounted to said bottom edge of said left side panel, said left side panel having a front surface, said left side shelf member capable of assuming a position substantially perpendicular to said front surface, with said left side shelf member in said position substantially perpendicular to said front surface and said left side panel being substantially perpendicular to said center panel a portion of said left side shelf member overrides said center shelf member.

2. The music stand as defined in claim 1 wherein:

the width of said right side panel being substantially equal to the width of said left side panel, the combined widths of said right side panel and said left side panel being substantially equal to the width of said center panel.

3. The music stand as defined in claim 2 wherein:

when said right side panel and said left side panel are in said planar alignment position said right side panel and said left side panel being slightly inclined relative to said front side thereby forming a slightly concave configuration.

* * * * *